US006758629B2

(12) United States Patent
Ortega et al.

(10) Patent No.: US 6,758,629 B2
(45) Date of Patent: Jul. 6, 2004

(54) RIGID RUNWAYS MADE OF POSTENSED CELLED CONCRETE FOR AIRPORTS AND HIGHWAYS

(75) Inventors: Pablo Cortina Ortega, Lomas de Chapultepecx (MX); Carlos Gutierrez Sarmiento, Estado de Mexico (MX)

(73) Assignee: Postensados y Diseno de Estructuras S.A. de C.V. (MX)

( * ) Notice: Subject to any disclaimer, the term of this patent is extended or adjusted under 35 U.S.C. 154(b) by 0 days.

(21) Appl. No.: 10/159,273

(22) Filed: Jun. 3, 2002

(65) Prior Publication Data

US 2003/0024186 A1 Feb. 6, 2003

(30) Foreign Application Priority Data

Jun. 4, 2001 (MX) ..... PA/a/2001/005601

(51) Int. Cl.[7] ..... E01C 3/00

(52) U.S. Cl. ..... 404/27; 404/17; 404/44; 404/70; 404/71

(58) Field of Search ..... 404/34, 17, 27, 404/31, 44, 70, 71

(56) References Cited

U.S. PATENT DOCUMENTS 3,732,791 A * 5/1973 Hohwiller et al. ..... 404/31
4,186,536 A * 2/1980 Piazza ..... 52/309.12
4,334,798 A 6/1982 Milne
4,605,337 A 8/1986 Springston et al.
4,655,016 A * 4/1987 Jacob ..... 52/169.1
4,797,026 A * 1/1989 Webster ..... 404/28
4,888,590 A * 12/1989 Chase ..... 342/3
5,007,764 A * 4/1991 Pontynen ..... 404/70
5,095,674 A * 3/1992 Huettemann ..... 52/405.3
5,440,845 A * 8/1995 Tadros et al. ..... 52/309.12
5,482,399 A * 1/1996 Bright et al. ..... 404/17
5,775,835 A * 7/1998 Szekely ..... 404/34
6,102,613 A * 8/2000 Medico et al. ..... 404/17
6,409,423 B1 * 6/2002 Li ..... 404/49
6,422,784 B1 * 7/2002 Pellegrino et al. ..... 404/17
6,460,213 B1 * 10/2002 Flint et al. ..... 14/73

* cited by examiner

*Primary Examiner*—Gary S Hartmann
(74) *Attorney, Agent, or Firm*—Nixon Peabody LLP; Jeffrey L. Costellia

(57) ABSTRACT

A postensed celled concrete runway for take off and landing of aircraft is described, also for racetracks, freeways and highways, characterized by a celled structure wherein each cell contains: nervures, a cell base and a cell cover that forms the surface of runway. A core composed of expanded polystyrene is located between the nervures, base and cover, such that the volume weight of the cells is less than subsoil density. The celled structure also contains a leveling means that acts over cells of the celled structure to allow the cells to move in an upward and downward direction so that the runway surface can be leveled when there are sunken areas on the ground.

14 Claims, 6 Drawing Sheets

RIGID RUNWAYS MADE OF POSTENSED CELLED CONCRETE FOR AIRPORTS AND HIGHWAYS

CROSS-REFERENCE TO RELATED APPLICATION

This application claims priority to Mexican Patent application number PA/a/2001/005601 filed Jun. 4, 2001

BACKGROUND OF THE INVENTION

1. Field of the Invention

The present invention is directed generally toward a postensed celled concrete runway for aircraft, racetracks, highways, and freeways that is specifically designed to maintain the levelness of aircraft, racetrack, highway, and freeway surfaces.

2. Description of the Related Art

Runways for takeoff and landing of aircraft, racetracks, highways, and freeways suffer from sinking due to ground settling.

Particularly runways for takeoff and landing of aircraft require certain characteristics in order to operate adequately. It is desirable that the surface of these runways remain substantially flat throughout its length. However, it has been observed that said runways loose their flatness because of diverse causes.

Vertical forces due to the weight of the runway and that of the aircraft, as well as the consolidation process of the subsoil, cause the formation of craters on the surface of the runway. These effects are amplified by soil conditions on which these runways are built. The argillaceous-arenaceous soil has a consolidation process longer than other kinds of earth, which increases runway defects.

On rainy seasons the problem is increased. The water accumulates in the sunken zones forming ponds on runway surfaces. These ponds make landing and take off maneuvers risky. Therefore, these ponds are unacceptable.

To solve the problems mentioned above, several solutions have been proposed. One solution consists of using a single layer made of materials that contain stabilizing agents and ground reinforcements. The U.S. Pat. No. 4,334,789 describes a method to fill craters using said agents.

A second method of solving this problem consists of covering runways with a polymeric layer. The U.S. Pat. No. 4,605,337 describes a runway that uses a layer of panels made of reinforced fiberglass anchored to the earth with tensioning means to the runway surface, thus avoiding the undulations of runways particularly when the landing gear of a plane uses the brakes when landing.

Said method however, has the disadvantage of requiring the frequent replacement of plastic panels that are eroded by the action of vertical and horizontal strengths during normal operation of runways. Additionally, said system of panels is unable to avoid the undulation of runway due to the sinking of ground, particularly the ones that happen on argillaceous-arenaceous soil of high compression.

In view of the problems mentioned above, the localization of runways on argillaceous-arenaceous subsoil of high compression makes it subject to studies and exhaustive technical investigations to check that the ground is satisfactory in order to allow its construction under acceptable economical parameters. We can mention some examples of countries with these problems: runways in the airports in Amsterdam, Netherlands and Mexico City. It should be mentioned that the alternate airport in Mexico City in the former lake of Texcoco, will face the same problem.

SUMMARY OF THE INVENTION

The present invention provides a solution that avoids the expensive maintenance of periodic releveling and re-coating on runways for aircraft, as currently happens in actual runways.

In the case of car racing tracks, flatness is also a desirable characteristic for pilots' safety and is also beneficial for car racing events.

Regarding freeways and highways, they are subject to the action of the environment and strengths exerted by the way of heavy auto-transport that generates a deterioration of freeways. Due to the fact that freeways and highways are essential for transportation of various merchandise, it is required that the freeway and highway networks are maintained in optimum conditions.

It is an object of the present invention to provide a rigid runway made of postensed celled concrete.

Another object of the invention is to eliminate the re-coating of runways in airports.

Still another object of the invention is to have a runway or road capable of leveling itself automatically.

Another object of the invention is to provide a method to re-level runways in air fields, especially airports, as well as in racetracks, freeways and highways.

DETAILED DESCRIPTION OF THE INVENTION

In accordance with the present invention, runway 10 is described as having applications in runways for take off and landing of aircraft as well as in racetracks or highways and freeways.

Runway 10 is described as being made of celled postensed concrete. The runway is composed of a structured cell 20 and leveling means 30.

The runways are built over an unaltered land surface, only the organic material layer is taken away from the surface.

Figure 5:
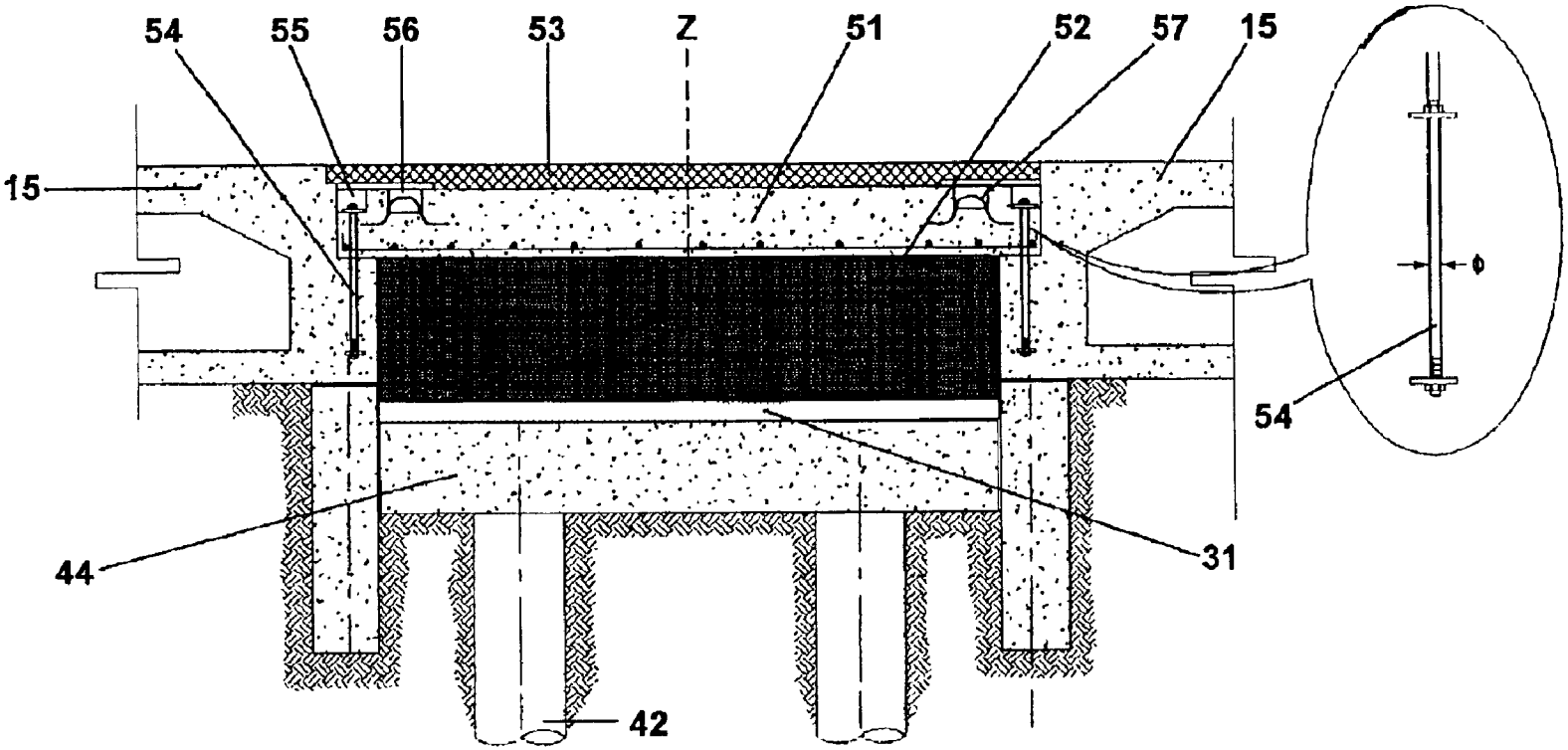
FIG. 5 illustrates a cross sectional view as taken through line 5—5 of FIG. 1 which shows the leveling means and the maintenance register of the runway of the invention.

Preferably, the runways are built over a layer of polyethylene 26 to reduce friction of the runway with subsoil and to have more efficient performance of the strengths and pre-strengths. FIG. 5 illustrates this layer.

FIGS. 1 to 6 illustrate runway 10 that is composed of a celled structure 20 and leveling means 30.

Figure 1:
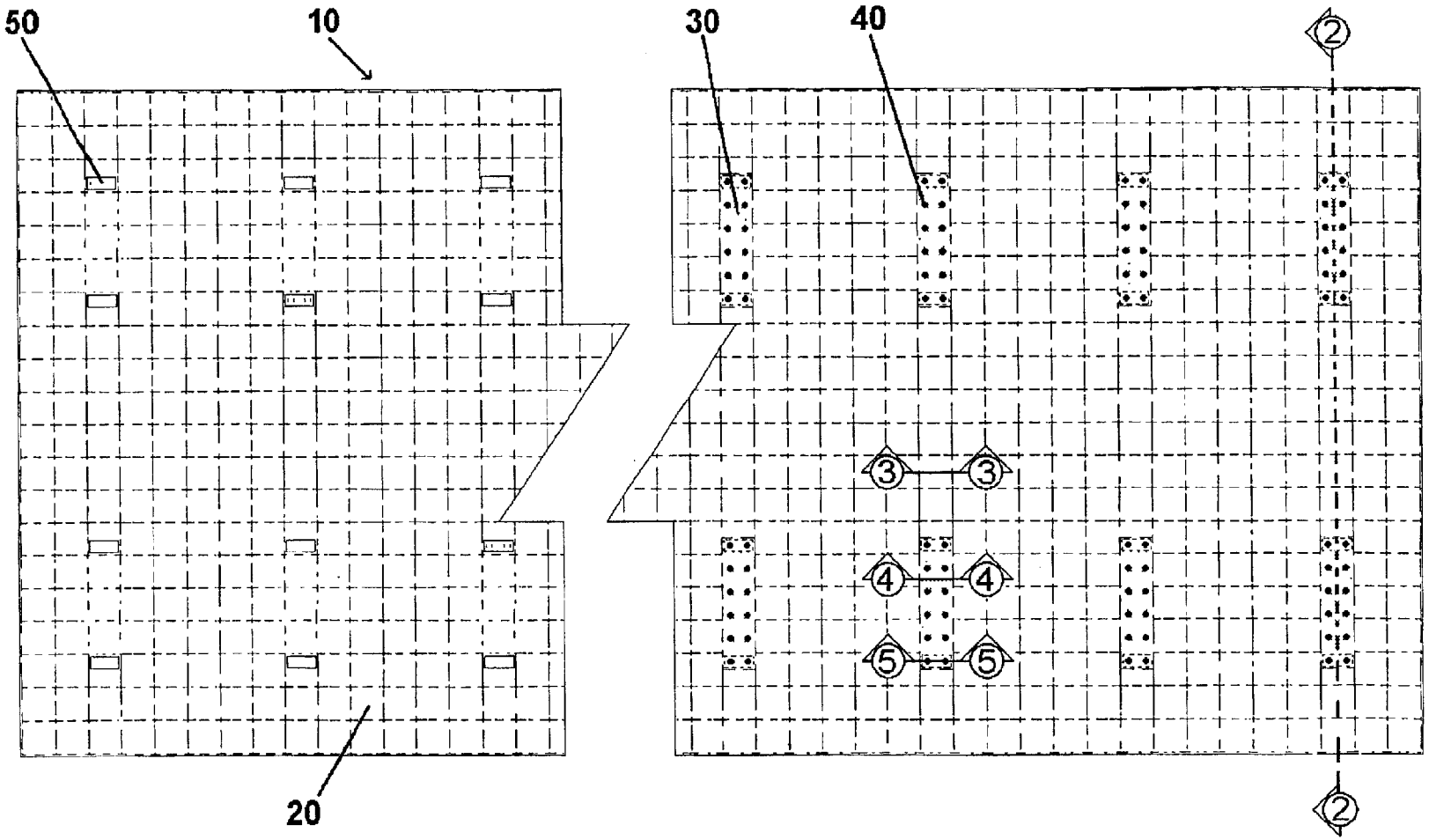
FIG. 1 illustrates a top view of a runway for aircraft, racetrack, highway and freeway in accordance to the present invention.
Figure 2:
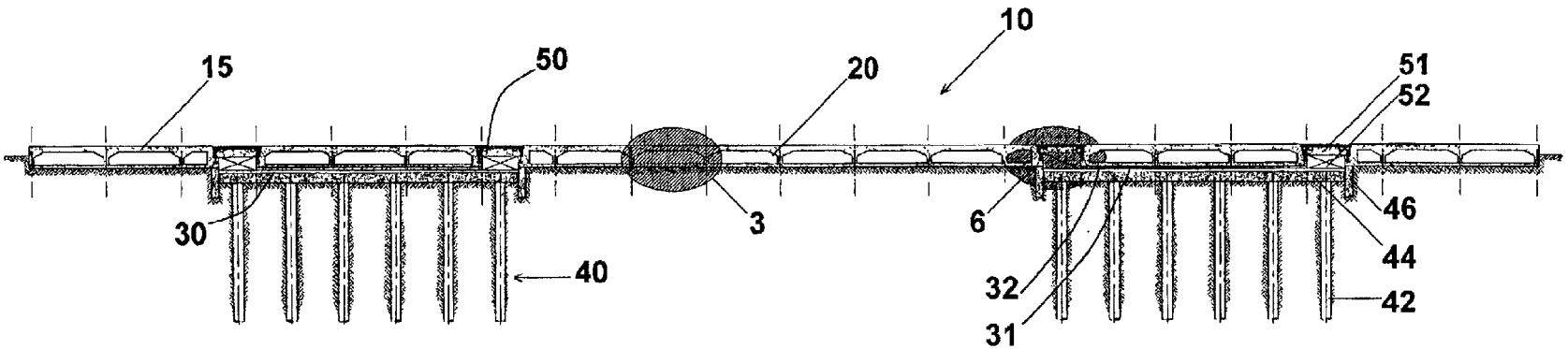
FIG. 2 illustrates a cross sectional view along of line 2—2 of FIG. 1 which illustrates the celled structure, leveling means, cementation, and maintenance registers of the runway of the invention.

The celled structure is composed of cells 15. The cells 15 are illustrated in FIGS. 1, 2, 3, and 4. In FIG. 1, cells are illustrated with dotted lines.

Figure 3:
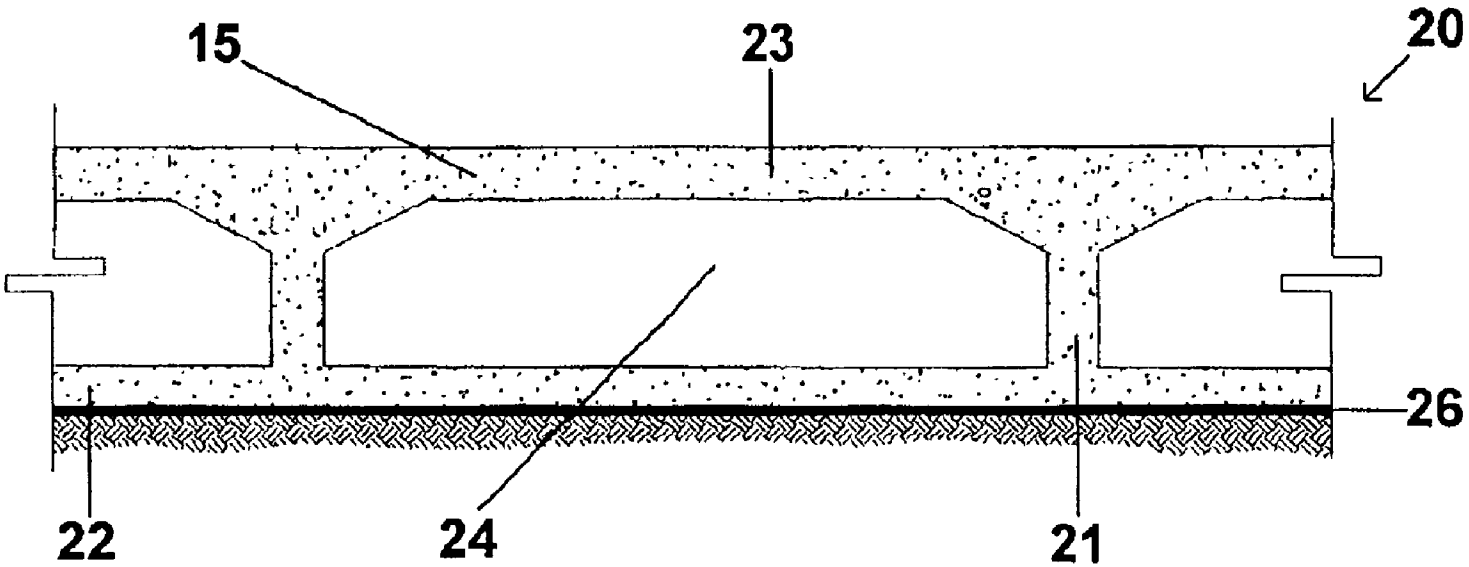
FIG. 3 illustrates a cross sectional view along of line 3—3 of FIG. 1 as well as detail 3 in FIG. 2, which shows a cell of the structured cell of the runway of the invention.

FIG. 3 illustrates a cell 15 in a transversal cut lengthwise of line 2—2 of FIG. 1. The cell structure is similar to orthogonal axis of line 3—3. This is illustrated as detail 3 in FIG. 2.

The cell contains orthogonal nervures 21 these are illustrated in FIG. 1 as horizontal and vertical dotted lines. They also consist of a cell base 22 and a cell covering 23 that forms the surface of runway 10. Between nervures 21, base 22 and covering 23, is placed a core 24 of expanded polystyrene. Each cell is joined with the adjacent cell, so that the celled structure 15 acts as one unit.

In the union of nervures 21 with covering 23, a reinforcement 25 of the cell can be optionally placed. Reinforcement 25 has the objective of distributing the vertical weight over the surface of the runway in nervures 21. As it is illustrated in FIG. 3, said reinforcement consists of a widening in the superior portion of the nervure.

Cells 15 have a parallelepiped form. The width of nervure 21, base 22, and covering 23 is approximately between 10 and 30 cm. The dimensions of each cell are approximately 3×3 m. Therefore, each cell has a surface of approximately 9 $m^2$. The cells cover the surface of the runway approximately 60×5000 m.

It will be understood by those skilled in the art that cells may have any geometry, for example, they can have the form of a triangular, polygonal, or cylindrical honeycomb.

With said arrangement of cells, the volume weight of the cells is less than the density of the soil (1.2 ton/$m^2$ approx.). In that regard, the sensibility of the settling of the ground on the runway is reduced.

In accordance with an embodiment of the invention, the variations of the level of soil that could still be present and cause irregular settling throughout the length of the runway are corrected through leveling means 30.

Preferably, runways have leveling means 30 disposed every section of 150 m approximately throughout the length of its longitude. The longitude of the runway can be variable. In the case of runways for aircraft, a longitude of 5,000 m is considered adequate.

Leveling means 30 are built under the surface of runway 10. It comprises an area greater than 25 $m^2$, and are capable of lifting a weight greater that 500 tons with pressures no greater than 2 bars.

Leveling means 30 comprises pneumatic or hydraulic jacks over a cementation 40 of reinforced concrete.

Cementation 40 of each leveling means 30 is illustrated according to Figures as a group of stakes 42 arranged in 2 rows of 6 stakes each. It is preferable that the stakes are manufactured in reinforced concrete and that they have a perimeter of around 120 cm and 12 m in length approximately. However, as it will be understood by those skilled in the art, the number of stakes, dimensions, arrangement and the pitch of the stakes can be variable.

In the top end of stakes 42, a concrete plate 44 is located. Said plate 44 transmits the weight on its surface to stakes 42. By virtue of means 42 and 44, cementation 40 offers a structural base and a stable level that serves as a reference for re-leveling of runway 10 when sinking is present on its surface.

Leveling of the runway is obtained through leveling means 30. Leveling means are found over plate 44 of cementation 40. Leveling means 30 act directly over cells 15 which spread out the weight in the celled structure 20.

Figure 4:
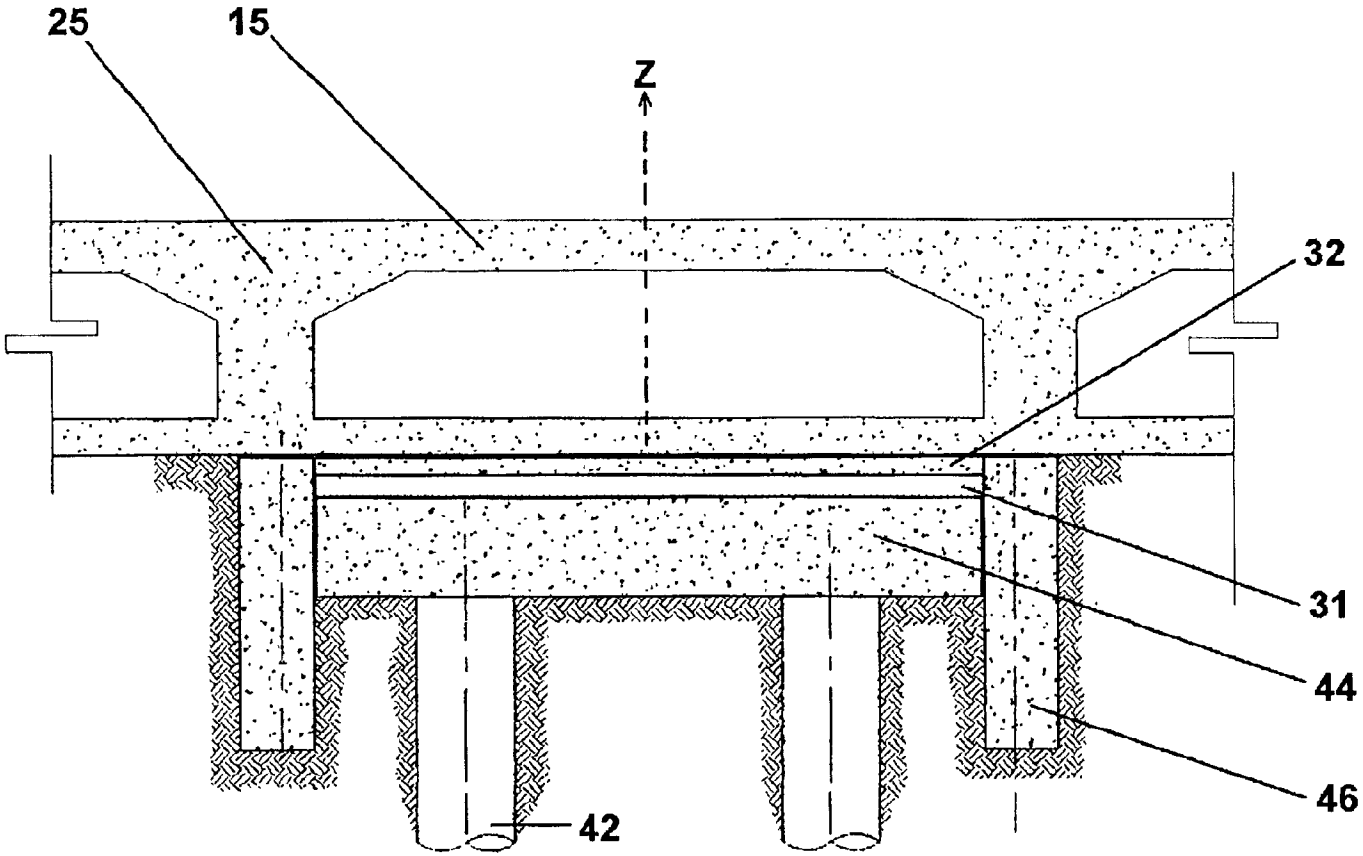
FIG. 4 illustrates a cross sectional view along of line 4—4 of FIG. 1 which illustrates the leveling means and the cells of the runway of the invention.
Figure 6:
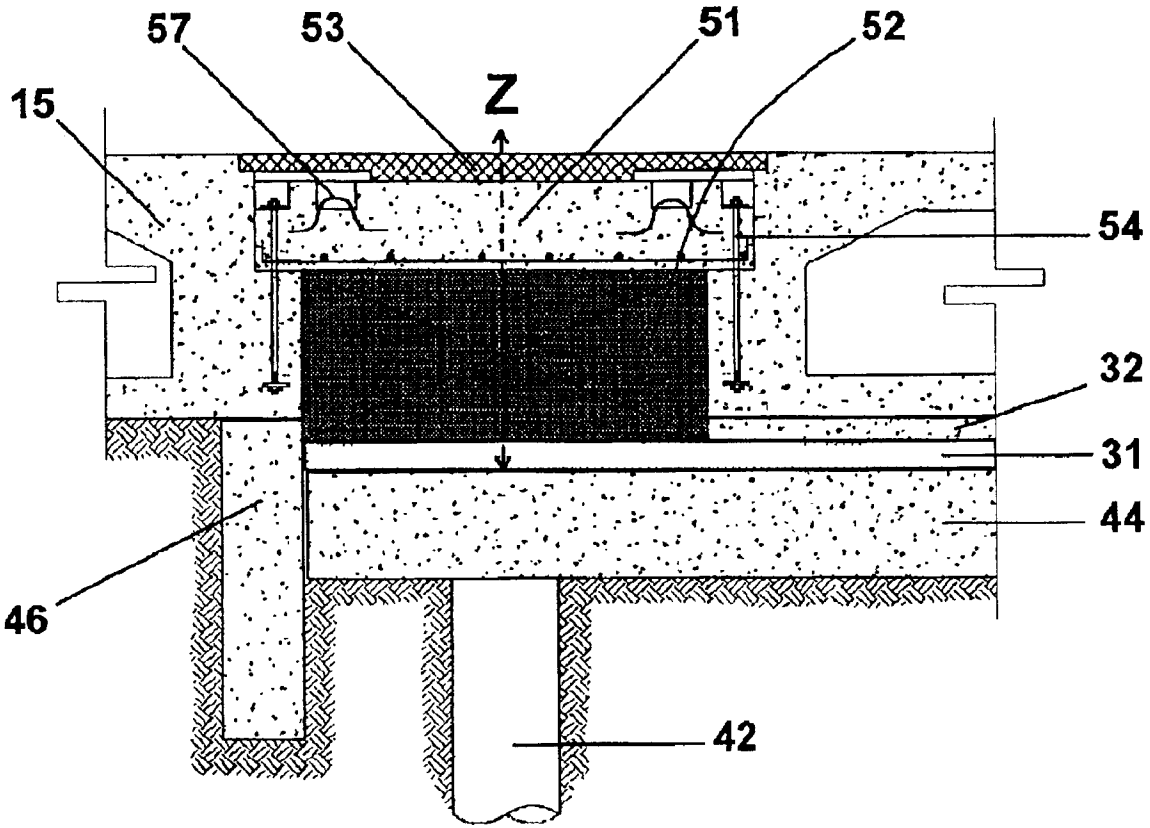
FIG. 6 illustrates detail 6 of FIG. 2, it shows the leveling means and the maintenance register of the runway in accordance with the present invention.

FIGS. 4, 5 and 6 illustrate leveling means 30. Leveling means 30 are comprised of bags 31 that contain a fluid in their interior. Said bags, due to the mass of fluid that are contained, are capable of expanding and contracting its volume. The bags are found in chambers defined by the following elements; at the bottom, the concrete plate 44, on each side, guiding blocks 46, and the superior portion (or lid) of cells 15.

The bags 31 that contain fluid are found under cells 15. The bottom and the lateral walls of the chamber are found substantially fixed, this enables the lid (cells 15) to move up or down, depending on the volume of bag 31.

The guiding blocks 46 that also form part of cementation 40, have the objective of guiding and containing the bag under cells 15. The height of guiding blocks 46 defines "the movement of the piston" that is the height that can be reached by bag 31.

The bags 31 are made of rubber (for example neoprene, polypropylene) or flexible plastic that are filled by pressure by a network of tubes, motor valves and a pumping system or compressors (not illustrated) to inject the fluid. The fluid can be gaseous or liquid, for example air or water.

Leveling means 30 are not limited to bags 31 that contain a fluid, as it is evident to the subject, pneumatic or hydraulic pistons can be used or mechanical means like screws that permit that cells 15 move in a Z—Z direction.

Optionally a smooth plate 32 can be placed between the bags 31 and the base 22. Smooth plate 32 has the objective of protecting bag 31 from movement induced by cells 15.

The variations in the mass of said fluid lead to a variation of the volume of the chamber in which bag 31 is found, at the same time said variation of its volume provokes movement in the Z—Z axis (FIG. 4). If fluid is injected and as a consequence the volume of bag 31 expands, there will be upward movement that will elevate the surface of the runway. On the other hand, if the fluid is removed from bag 31, the volume of the bag will decrease and this lowering will reflect as a lowering of the surface of the runway.

As it can be appreciated on FIG. 4, the movement of bag 31 on the Z—Z axis makes the cells 15 that are found over bag 31, as well as the adjacent cells to move on the Z—Z direction. The movement of leveling means distributed throughout the length of the runway permit the possibility of re-leveling said runway when there are sunken areas.

Additionally, runways are provided with vertical tubes (not illustrated) for the injection of a filler, such as benthonic sludge. The tubes are placed in vertical bore holes of approximately 3.81 cm (1.5 inches) in diameter placed each 10 m throughout the width and length of the runway and having lids to prevent the entrance of contaminants under the celled structure 20.

The benthonic sludge have the objective of filling the cavity formed between the settling of the ground and the celled structure 20 when it has been leveled. The injection of said sludge to fill said cavity has the objective of reinforcing the base of runway.

In order to provide maintenance to leveling means 30, the runway in accordance with the present invention contains maintenance registers 50. The registers 50 are illustrated in detail in FIGS. 5 and 6.

The cells are found adjacent to registers 50. As illustrated in FIG. 1, there is a register 50 on each end of leveling means 30. However, as it will be understood by those skilled in the art, it is possible to place one or more than two registers on each leveling mean 30.

Register 50 contains a register lid 51, a filler block 52 and optionally a lid cover 53.

The lid of register 51 is fastened to the celled structure 20 by fasteners 54. Register 50 is illustrated in FIGS. 5 and 6, cross sectional view 5—5 and detail 6 of FIG. 2.

Fasteners 54 as well as bolts with screwed ends, join the lids of register 51 with the adjacent cells. Any conventional method of joining can be used. FIG. 5 illustrates the first end of fastener 54, being anchored to cell 15, while the second end of fastener 54 goes through the lid of register 51, that is found bored and is fixed by a bolt.

It is preferred that the fasteners have a diameter of approximately 3.81 cm (1.5 inches). Fasteners are a available as needed.

The register lids also contain cavities 55 and 56. Cavity 55 has the objective to manipulate fastener 54, while the objective of cavity 56 is to give way to the holders 57 to remove the register lid when fasteners 54 have been removed. The register lid is made of concrete.

The optional cover 53 covers lid 51. Said cover 53 has the objective of conserving continuity of the surface of the runway as well as preventing the entrance of water and other contaminants to leveling means 30 and cementation 40. The register lid cover is preferably made of asphalted concrete.

The objective of filler block 52 is to hold fluid bag 31 and to provide a restraint to the expansion of bag 31 in register 50. It also offers protection against rupture of bags 31. Said block 52 is preferably made of high density polystyrene.

As illustrated in FIGS. 5 and 6, smooth plate 32 does not extend under block 52 and this allows the chamber where fluid bag 31 is confined, provide a uniform surface.

The structured runway 20 with cells 15 is capable of bridging its own weight and its overweight by its supports in leveling means 30. In other words, the celled structure 20 moves according to the height level that is established in cells 15 by way of leveling means 30. That way all sections of the runway and not only the cells that are over the bag 31 will have an ascending movement, which results in the leveling of the whole surface of runway 10.

To control a runway's level in the place of sinking, provoked by the variation in the ground level, the runway additionally contains automated means to control the level of the runway, for example; said means comprise level and/or inclination sensors for each leveling means 30 that through an automatic computer system, starts the fluid injection or extraction system to bags 31.

Each leveling means 30 will have registers 50 that permit its access to: (a) Return the "movement of the piston" to its original position when this has expanded to its design limits. (b) Change the container bag when necessary. (c) Make other types of changes if it is chosen.

To make said maintenance, an operator must first remove lid cover 53, then unscrew fasteners 54 and remove lid 51. For that, holders 57 are optionally available. After removing lid 53 block 52 should be removed. After removing said elements the operator has access to fluid bag 31.

If registers need to be opened, repairs and/or adjustments can be done in a maximum of 2 hours, avoiding in this way high maintenance and operation costs of runways.

To make said maintenance, an operator must file remove lid cover 53, then unscrew fasteners 54 and remove lid 51. For that, holders 57 are optionally available. After removing lid 53 block 52 should be removed. After removing said elements the operator has access to fluid bag 31.

If registers need to be opened, repairs and/or adjustments can be done in a maximum of two hours, avoiding in this way high maintenance and operation costs of runways.

What is claimed is:

1. A postensed celled concrete runway for aircraft, racetracks, highways, and freeways comprising:

a celled structure in which the cells are composed of, nervures, a cell base, and a cell covering;

wherein said cell covering forms the surface of a runway; and wherein a core of expanded polystyrene is interdisposed between said nervures, said base and said covering, such that the volume weight of the cells is less than the density of the subsoil.

2. The postensed celled concrete runway of claim 1, further comprising a leveling means that acts over the cells of said celled structure, wherein said leveling means permit cells to move in an upward or downward direction.

3. The postensed celled concrete runway of claim 2, wherein said leveling means is comprised of a cement base which acts as a base and a level reference for leveling the runway.

4. The postensed celled concrete runway of claim 3, wherein said cement base is comprised of a plurality of stakes.

5. The postensed celled concrete runway of claim 4, wherein said plurality of stakes further comprise a concrete plate.

6. The postensed celled concrete runway of claim 2, wherein said leveling means comprises a bag in a chamber under the cells;

wherein said chamber is defined by a first plate, guiding blocks, and the lid of said cells.

7. The postensed celled concrete runway of claim 6, further comprising a second plate between said bags and said base to protect said bag from cell movement.

8. The postensed celled concrete runway of claim 2, wherein said leveling means further comprises a register for facilitating maintenance of said leveling means.

9. The postensed celled concrete runway of claim 8, wherein said register contains a register lid, a filler block and a lid cover.

10. The postensed celled concrete runway of claim 9 wherein said register lid is attached to the celled structure by fasteners.

11. The postensed celled concrete runway of claim 2, further comprising vertical tubes for injecting a filler material into the cavities formed between the the ground and the leveled cell structure.

12. The postensed celled concrete runway of claim 11, wherein said vertical injection tubes are spaced approximately every 10 meters throughout the width and length of runway.

13. The postensed celled concrete runway of claim 2, further comprising a automated means for controlling the surface level of the runway.

14. The postensed celled concrete runway of claim 13, wherein said automated means contain level sensors on each mean of leveling controlled by an automated computer system which activates the system of injection or extraction of fluid to bags.

* * * * *